US012560391B2

(12) United States Patent
Kitao et al.

(10) Patent No.: US 12,560,391 B2
(45) Date of Patent: Feb. 24, 2026

(54) FIN ASSEMBLING METHOD

(71) Applicant: DAIKIN INDUSTRIES, LTD., Osaka (JP)

(72) Inventors: Hiroyuki Kitao, Osaka (JP); Yoshihiro Tsutsumi, Osaka (JP); Motofumi Shimizu, Osaka (JP); Takayuki Takahashi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/890,308

(22) Filed: Sep. 19, 2024

(65) Prior Publication Data

US 2025/0012519 A1 Jan. 9, 2025

Related U.S. Application Data

(63) Continuation of application No. PCT/JP2023/002279, filed on Jan. 25, 2023.

(30) Foreign Application Priority Data

Mar. 31, 2022 (JP) ..... 2022-060684

(51) Int. Cl.

| | |
|---|---|
| ***F28F 3/08*** | (2006.01) |
| ***B21D 43/22*** | (2006.01) |
| ***B21D 53/02*** | (2006.01) |
| ***B21D 53/08*** | (2006.01) |

(52) U.S. Cl.

CPC ..... *F28F 3/08* (2013.01); *B21D 53/025* (2013.01); *B21D 53/085* (2013.01); *B21D 43/22* (2013.01)

(58) Field of Classification Search

CPC ..... B21D 53/085

See application file for complete search history.

(56) References Cited

U.S. PATENT DOCUMENTS

| | | | | |
|---|---|---|---|---|
| 4,566,359 | A * | 1/1986 | Miyagi | B21D 53/085 83/100 |
| 9,079,277 | B2 * | 7/2015 | Karasawa | B21D 53/022 |
| 10,343,239 | B2 * | 7/2019 | Lee | B23P 15/00 |
| 2006/0070726 | A1 | 4/2006 | Yoshioka et al. | |
| 2014/0090238 | A1 | 4/2014 | Karasawa et al. | |
| 2014/0374077 | A1 | 12/2014 | Lee et al. | |
| 2016/0003547 | A1 | 1/2016 | Okazawa et al. | |
| 2016/0082555 | A1 | 3/2016 | Nishimura et al. | |

(Continued)

FOREIGN PATENT DOCUMENTS

| | | | |
|---|---|---|---|
| CN | 203903419 | U | 10/2014 |
| CN | 109128747 | A | 1/2019 |
| EP | 3 175 948 | A1 | 6/2017 |

(Continued)

OTHER PUBLICATIONS

International Search Report of corresponding PCT Application No. PCT/JP2023/002279 dated Mar. 28, 2023.

(Continued)

*Primary Examiner* — Sarang Afzali

(74) *Attorney, Agent, or Firm* — Spencer Fane LLP

(57) ABSTRACT

Each of a plurality of fins has a fin slit for receiving a flat tube. A method for stacking the fins includes arranging each of the fins at a stacking spot for the fins with an opening of the fin slit facing upward or downward.

6 Claims, 7 Drawing Sheets

(56) References Cited

U.S. PATENT DOCUMENTS

2017/0334028 A1 11/2017 Karasawa

FOREIGN PATENT DOCUMENTS

| | | | |
|---|---|---|---|
| JP | 59-23685 | Y2 | 7/1984 |
| JP | 5-330606 | A | 12/1993 |
| JP | 2013-59847 | A | 4/2013 |
| JP | 5594674 | B2 | 8/2014 |
| JP | 2020-76535 | A | 5/2020 |
| WO | 2004/059234 | A1 | 7/2004 |

OTHER PUBLICATIONS

International Preliminary Report of corresponding PCT Application No. PCT/JP2023/002279 dated Oct. 10, 2024.
European Search Report of corresponding EP Application No. 23 77 8789.0 dated Apr. 29, 2025.

* cited by examiner

FIN ASSEMBLING METHOD

CROSS-REFERENCE TO RELATED APPLICATIONS

This is a continuation of International Application No. PCT/JP2023/002279 filed on Jan. 25, 2023, which claims priority to Japanese Patent Application No. 2022-060684, filed on Mar. 31, 2022. The entire disclosures of these applications are incorporated by reference herein.

BACKGROUND

Technical Field

The present disclosure relates to a method for stacking fins.

Background Art

Japanese Patent No. 5594674 discloses an apparatus for manufacturing a stack of fins for a heat exchanger. The apparatus can automatically perform the whole processes from the pressing of the fins for the heat exchanger to the taking out of the stack of the fins for the heat exchanger. Previously, multiple fins are vertically stacked. However, when the fins are stacked too high, the fins on the upper portion of the stack are more unstable. Thus, it has been difficult to stack the fins very high.

SUMMARY

A first aspect is directed to a method for stacking fins. Each of a plurality of fins has a fin slit for receiving a flat tube. The method for stacking the fins includes arranging each of the fins at a stacking spot for the fins with an opening of the fin slit facing upward or downward.

DETAILED DESCRIPTION OF EMBODIMENT(S)

Embodiments of the present disclosure will be described in detail below with reference to the drawings. The present disclosure is not limited to the embodiments shown below, and various changes can be made within the scope without departing from the technical concept of the present disclosure. Each of the drawings is intended to illustrate the present disclosure conceptually, and dimensions, ratios, or numbers may be exaggerated or simplified as necessary for the sake of ease of understanding.

An exemplary embodiment will be described in detail below with reference to the drawings.

Configuration of Fin

Figure 1:
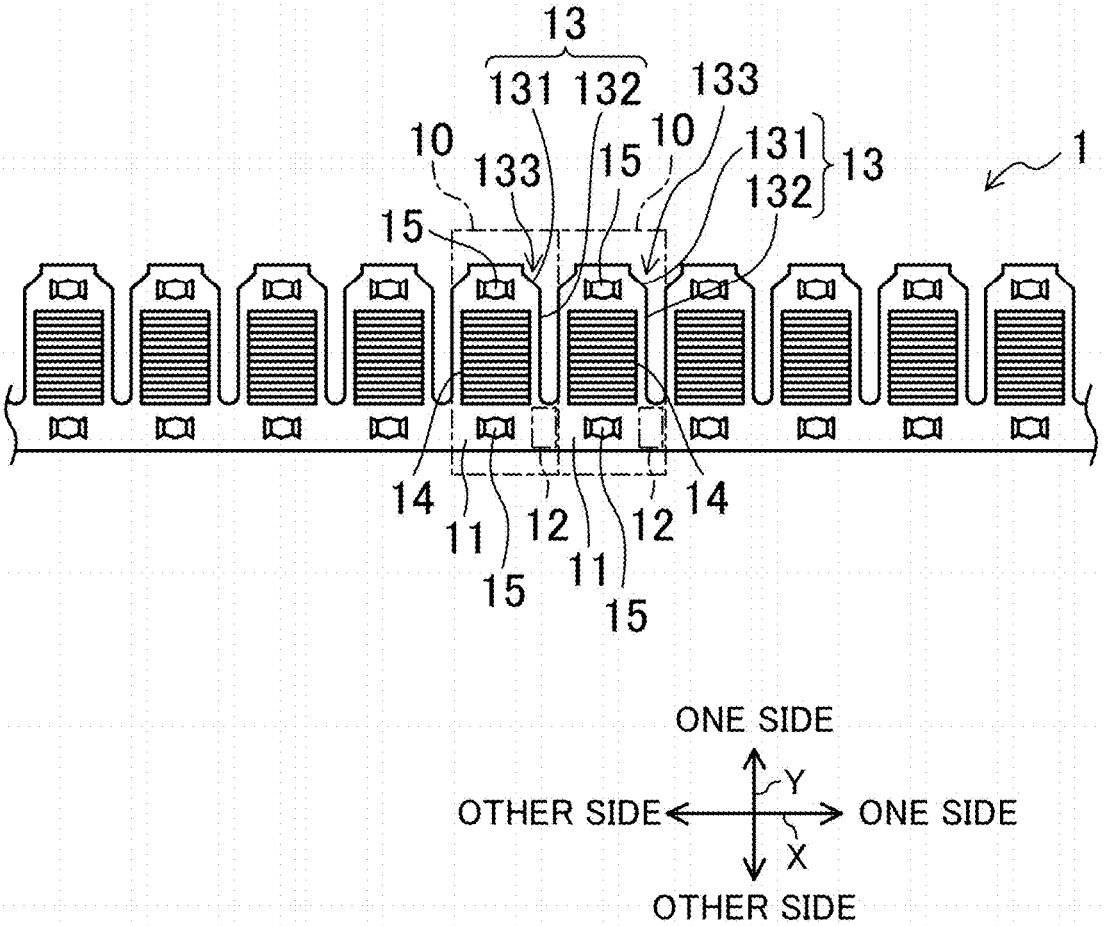
FIG. 1 is a plan view of a fin according to an embodiment.

FIG. 1 is a plan view of a fin (1) for a heat exchanger. In FIG. 1, an X-axis direction and a Y-axis direction are perpendicular to each other. The heat exchanger is provided in, for example, an indoor unit or outdoor unit of an air conditioner. The heat exchanger is a device that condenses or evaporates a refrigerant using air as a cooling source or a heating source, and is, for example, a component of a refrigerant circuit of a vapor compression refrigeration apparatus. Examples of the refrigerant circulating through the refrigerant circuit include a carbon dioxide refrigerant.

The fin (1) includes a plurality of structural units (10). The structural units (10) are continuously arranged side by side in the X-axis direction. The structural unit (10) each include a plate-shaped portion (11), a continuous portion (12), a fin slit (13), a waffle portion (14), and fin tabs (15).

The plate-shaped portion (11) is a plate-shaped member. The plate-shaped portions (11) are arranged side by side in the X-axis direction. The continuous portion (12) is provided between an adjacent pair of plate-shaped portions (11).

The continuous portion (12) is a plate-shaped member. The continuous portion (12) is provided to be continuous with each of the adjacent plate-shaped portions (11). The continuous portion (12) has surfaces in the X-axis direction and Y-axis direction that are flush with each of the adjacent plate-shaped portions (11). The continuous portion (12) is located between the plate-shaped portions (11) adjacent to each other. The continuous portion (12) is located on the other side of the fin (1) in the Y-axis direction.

The fin slit (13) is a space formed between the adjacent plate-shaped portions (11) and the continuous portion (12). The fin slit (13) extends in the Y-axis direction. The fin slit (13) is provided between the adjacent plate-shaped portions (11) on one side of the continuous portion (12) in the Y-axis direction. For the fin slit (13), one side and the other side in the X-axis direction are blocked by the plate-shaped portions (11), one side in the Y-axis direction is open, and the other side in the Y-axis direction is blocked by the continuous portion (12). The fin slit (13) includes a first slit portion (131) and a second slit portion (132). The first slit portion (131) is a portion of the fin slit (13) located on one side in the Y-axis direction. The second slit portion (132) is a portion of the fin slit (13) located on the other side in the Y-axis direction. The second slit portion (132) is continuous with the first slit portion (131) and extends from the first slit portion (131) toward the other side in the Y-axis direction. The fin slit (13) includes an opening (133) communicating with external space. The opening (133) is formed on one side of the first slit portion (131) in the Y-axis direction.

A flat tube for sending a refrigerant is inserted into the fin slit (13). The dimension of the second slit portion (132) in the X-axis direction is set to match the dimension of the flat tube so that the flat tube can fit into the slit. The first slit portion (131) is configured to have a larger dimension than the second slit portion (132) in the X-axis direction so that the first slit portion (131) functions as a guide slit that guides the flat tube entering the fin slit (13). This allows easy insertion of the flat tube into the fin slit (13).

The waffle portion (14) is provided on the plate-shaped portion (11), and is located at the center of the plate-shaped portion (11) in the Y-axis direction. The waffle portion (14) includes a raised portion and a non-raised portion. The raised portion is a portion raised in a thickness direction of the fin (1). The non-raised portion is a flat portion that is not raised in the thickness direction of the fin (1).

The fin tabs (15) are provided to regulate an interval between the fins (1) adjacent to each other in the thickness direction, and are arranged on both sides of the waffle portion (14) in the Y-axis direction.

There is no particular limitations on the other features of the fin (1) as long as the fin (1) has at least a plurality of fin slits (13).

First Embodiment

A first embodiment of the method for stacking the fins (1) will be described below.

Manufacture and Conveyance of Fins

The fin (1) is manufactured by pressing a metal plate with a die at a manufacturing spot (P). In the first embodiment, the fin (1) just manufactured at the manufacturing spot (P) is arranged in a horizontal position (F).

In the horizontal position (F), the fin (1) is laid down with the opening (133) of the fin slit (13) (see FIG. 1) facing horizontally.

First Variation of Fin Position Change

The position of the fin (1) is changed at a position changing spot (QA).

In the first embodiment, the position of the fin slit (13) is changed from the horizontal position (F) to a downward position (G) at the position changing spot (QA). In the downward position (G), the fin (1) is placed with the opening (133) of the fin slit (13) facing downward in the vertical direction.

A plurality of platforms (Q11) is arranged at the position changing spot (QA). The platforms (Q11) are arranged in line. A clearance (Q12) is present between the platforms (Q11) adjacent to each other.

Second guide plates (Q14) are provided on each of the platforms (Q11).

The fins (1) manufactured at the manufacturing spot (P) are conveyed in a conveying direction (E) while being separated by multiple first guide plates (Q13), and are sent onto the multiple platforms (Q11). The following description will be made focusing on one of the fins (1).

The fin (1) in the horizontal position (F) is arranged across the multiple platforms (Q11). The fin (1) is sandwiched between the second guide plates (Q14) from both sides on the platforms (Q11), thereby effectively keeping the fin (1) on the platforms (Q11).

When the fin (1) in the horizontal position (F) is placed across the multiple platforms (Q11), any of the fin slits (13) (see FIG. 1) is located above the clearance (Q12) between the platforms (Q11) and faces the clearance (Q12) in the vertical direction.

A plate-shaped or linear moving member (Q15) is disposed below the clearance (Q12) between the platforms (Q11).

Figure 2:
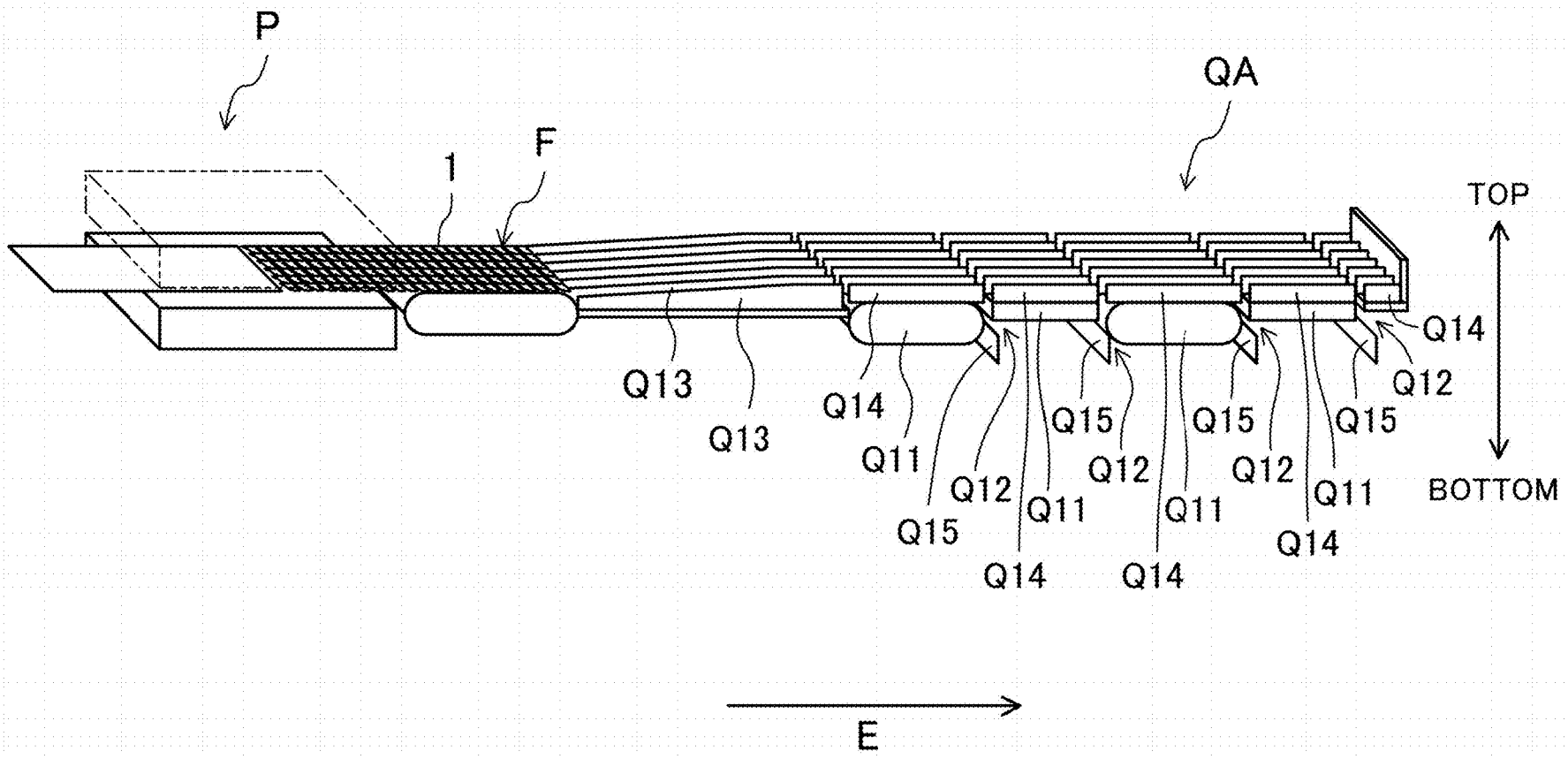
FIG. 2 is a schematic view of a configuration for changing the position of the fins that have been manufactured.
Figure 3:
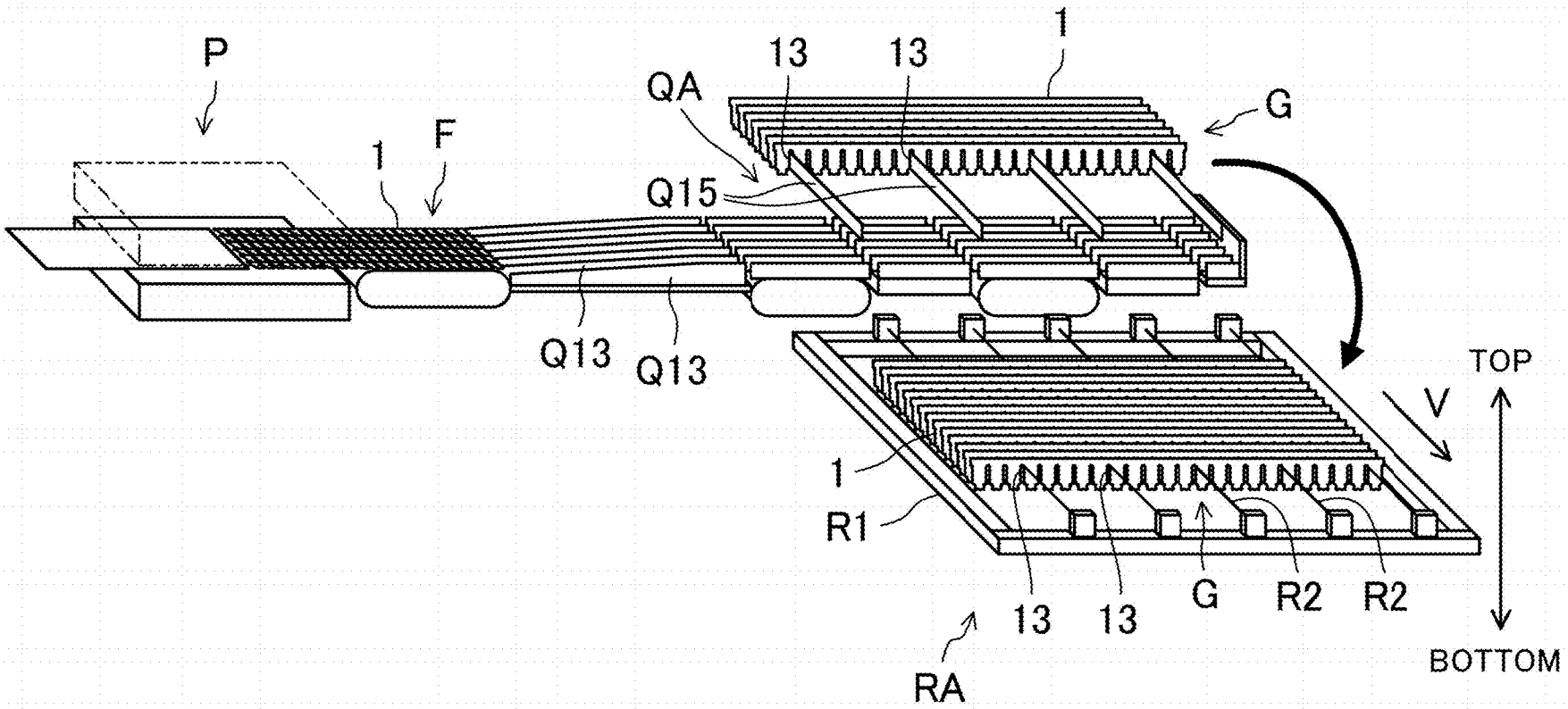
FIG. 3 is a schematic view of a configuration for stacking the fins that have changed the position.

As illustrated in FIGS. 2 and 3, when the fin (1) in the horizontal position (F) is placed across the platforms (Q11), the moving member (Q15) rises from below the clearance (Q12) to pass through the clearance (Q12). The moving member (Q15) passes through the clearance (Q12) and approaches the fin slit (13) of the fin (1) from below to lift up the fin (1). When the moving member (Q15) lifts up the fin (1), the fin (1) rotates about a point of contact between the moving member (Q15) and the fin slit (13) so that the opening (133) of the fin slit (13) faces downward. Thus, the moving member (Q15) enters the fin slit (13), and the position of the fin (1) is changed from the horizontal position (F) to the downward position (G). As a result, the moving member (Q15) is caught in the fin slit (13).

When the moving member (Q15) is caught in the fin slit (13), the moving member (Q15) makes contact with the bottom of the fin slit (13) of the fin (1) in the downward position (G) from below, thereby supporting the fin (1) from below. When the moving member (Q15) caught in the fin slit (13) moves, the fin (1) kept in the downward position (G) moves together with the moving member (Q15).

First Example of Stacking Fins

A tray (R1) for stacking the fins (1) is disposed at the stacking spot (RA) for the fins (1). The tray (R1) is a rectangular frame-shaped member with open top and bottom. The tray (R1) is provided with a plurality of supports (R2). The supports (R2) are arranged in parallel at intervals and extend horizontally. Each of the supports (R2) is a plate-shaped or linear member that can enter the fin slit (13).

The moving member (Q15) moves to the stacking spot (RA) for the fins (1) while supporting the fins (1) in the downward position (G). The fins (1) are transferred from the moving member (Q15) onto the supports (R2).

When the fins (1) are transferred from the moving member (Q15) onto the supports (R2), the supports (R2) enter the fin slits (13) to be caught in the fin slits (13). As a result, the fins (1) kept in the downward position (G) are supported by the supports (R2).

In the stacking spot (RA), the fins (1) are stacked to be arranged in a direction (V) of extension of the supports (R2).

The fins (1) are horizontally stacked at the stacking spot (RA). The horizontal stacking of the fins (1) means that the fins (1) in the downward position (G) or an upward position (H) are arranged side by side, with the fin slits (13) of the adjacent fins (1) overlapping each other when viewed from the direction (V) of arrangement of the fins (1).

Second Embodiment

A second embodiment of the method for stacking the fins (1) will be described below.

Configuration of Fin Position Changing Spot

Figure 5A:
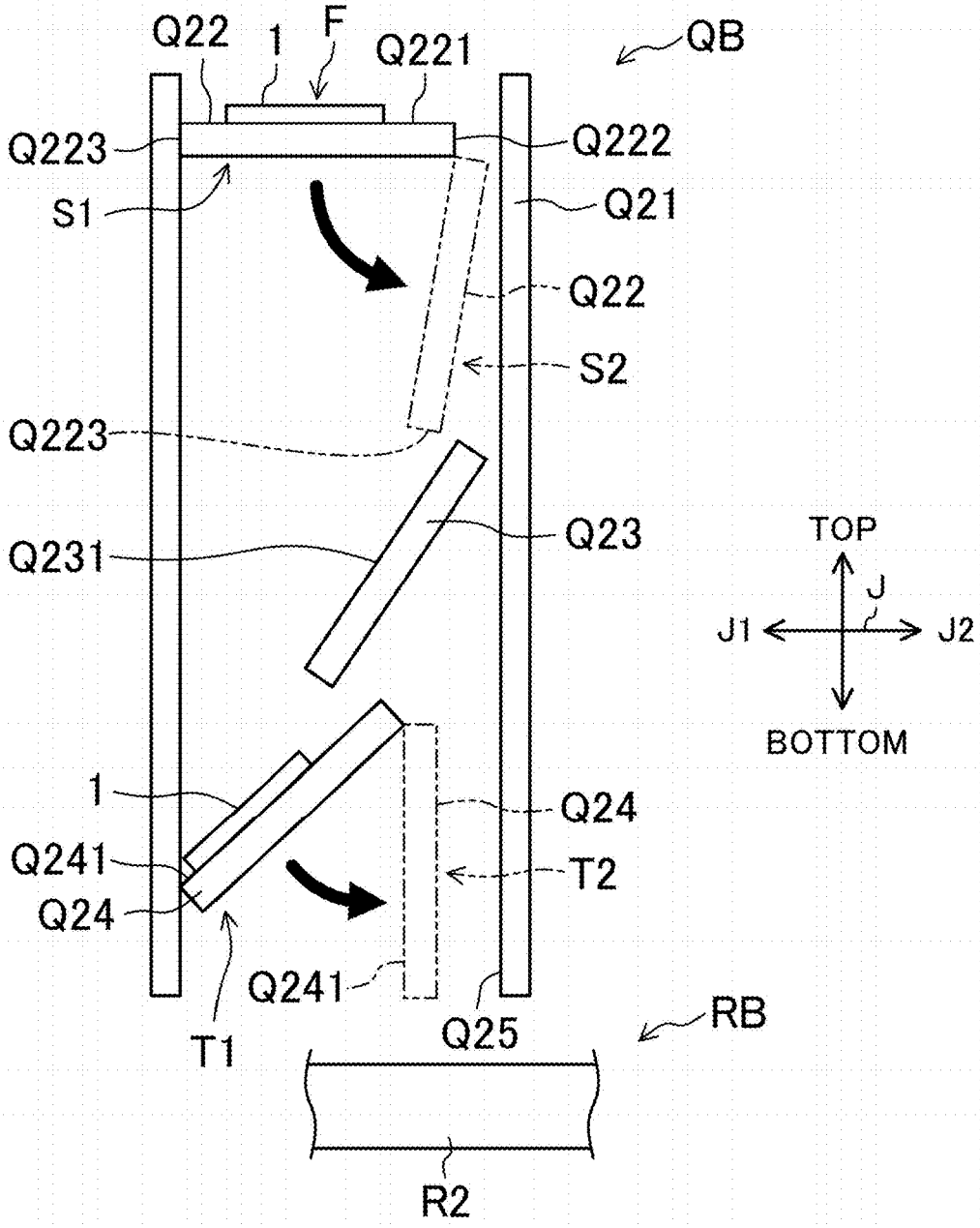
FIG. 5A is a schematic view of a configuration of a position changing spot for the fins and a stacking spot for the fins.

As illustrated in FIG. 5A, the position changing spot (QB) for the fins (1) is provided with a first guide (Q21), a first bed (Q22), a second bed (Q23), and a third bed (Q24).

Figure 4A:
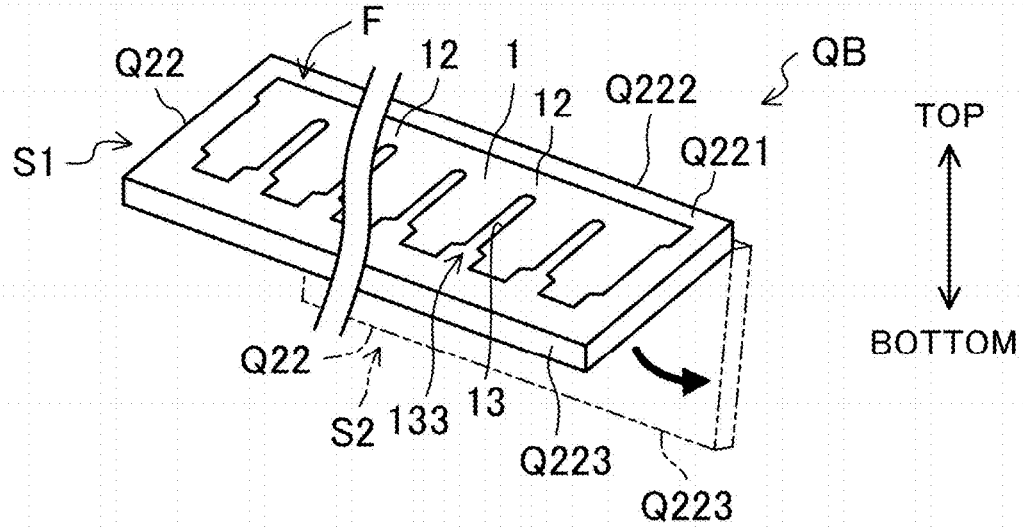
FIG. 4A is a perspective view of a first bed.

As illustrated in FIGS. 4A and 5A, the first guide (Q21) is a hollow member and is shaped to extend in the vertical direction. The first bed (Q22), the second bed (Q23), and the third bed (Q24) are provided in the first guide (Q21). An opening (Q25) is formed at the bottom of the first guide (Q21) so that the inside and outside of the first guide (Q21) communicate with each other.

The first bed (Q22) is rotatably supported. The first bed (Q22) is a plate-shaped member. The first bed (Q22) includes a first placement surface (Q221) on which the fin (1) manufactured at the manufacturing spot (P) (see FIG. 2)

is placed. The first bed (Q22) includes a center portion (Q222) which is the center of rotation and a rotating end portion (Q223) which rotates about the center portion (Q222).

When the first bed (Q22) rotates, the position of the first bed (Q22) is changed to any one of a horizontal position (S1) or an inclined position (S2). In the horizontal position (S1), the first placement surface (Q221) of the first bed (Q22) is parallel to the horizontal direction (J). In the inclined position (S2), the first placement surface (Q221) of the first bed (Q22) is inclined downward with respect to one side (J1) in the horizontal direction (J).

As illustrated in FIG. 5A, the second bed (Q23) is placed below the first bed (Q22). The second bed (Q23) is a plate-shaped member inclined downward with respect to the one side (J1) in the horizontal direction (J) and has a second placement surface (Q231).

As illustrated in FIGS. 4A and 5A, the third bed (Q24) is placed below the second bed (Q23). The third bed (Q24) is a plate-shaped member. The third bed (Q24) is rotatably supported. When the third bed (Q24) rotates, the position of the third bed (Q24) is changed to any one of an inclined position (T1) or a vertical position (T2). In the inclined position (T1), a third placement surface (Q241) of the third bed (Q24) is inclined downward with respect to the one side (J1) in the horizontal direction (J). In the vertical position (T2), the third placement surface (Q241) of the third bed (Q24) is parallel to the vertical direction.

As illustrated in FIG. 5A, the supports (R2) are disposed at a stacking spot (RB) for the fins (1). The supports (R2) are placed below the opening (Q25) of the first guide (Q21).

Second Variation of Fin Position Change

As illustrated in FIGS. 4A and 5A, the fin (1) manufactured at the manufacturing spot (P) (see FIG. 2) is placed in the horizontal position (F) on the first placement surface (Q221) of the first bed (Q22) in the horizontal position (S1) at the position changing spot (QB).

In the following description, a state in which the fin (1) in the horizontal position (F) is placed on the first placement surface (Q221) of the first bed (Q22) in the horizontal position (S1) may be referred to as a horizontally placed state.

When the fin (1) is in the horizontally placed state, the continuous portion (12) of the fin (1) is located near the center portion (Q222) of the first bed (Q22), and the opening (133) of the fin slit (13) is located near the rotating end portion (Q223) of the first bed (Q22).

When the fin (1) manufactured at the manufacturing spot (P) is placed on the first placement surface (Q221) of the first bed (Q22) to be in the horizontally placed state, the position of the first bed (Q22) is changed to the inclined position (S2). When the position of the first bed (Q22) is changed to the inclined position (S2), the fin (1) slides down the first placement surface (Q221). The fin (1) slides down the first placement surface (Q221) with the opening (133) of the fin slit (13) facing down.

The fin (1) slides down the first placement surface (Q221), falls off the first bed (Q22), lands on the second bed (Q23), and slides down the second placement surface (Q231) of the second bed (Q23).

Figure 4B:
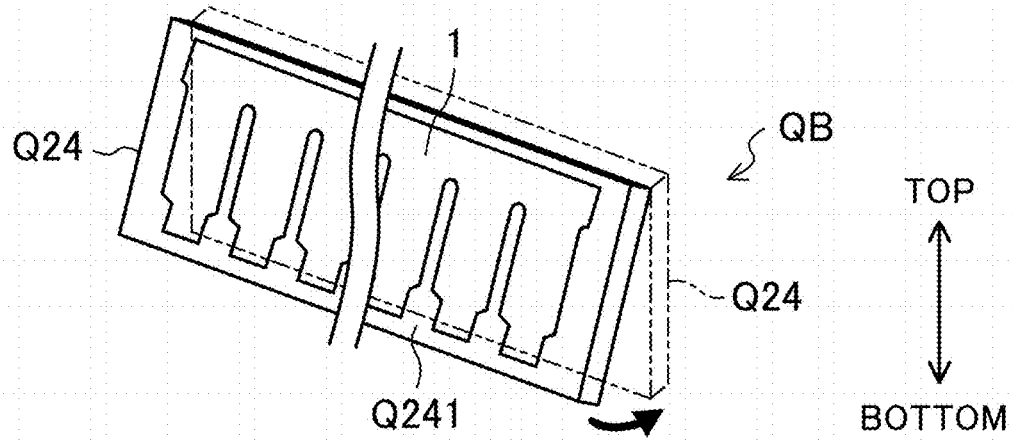
FIG. 4B is a perspective view of a third bed.

As illustrated in FIGS. 4B and 5A, the fin (1) slides down the second placement surface (Q231), falls off the second bed (Q23), and lands on the third bed (Q24) to be placed on the third placement surface (Q241) of the third bed (Q24).

When the fin (1) is placed on the third placement surface (Q241) of the third bed (Q24), the position of the third bed (Q24) is changed from the inclined position (T1) to the vertical position (T2). Thus, the fin (1) falls off the third bed (Q24) in the downward position (G) with the opening (133) of the fin slit (13) facing downward.

Figure 4C:
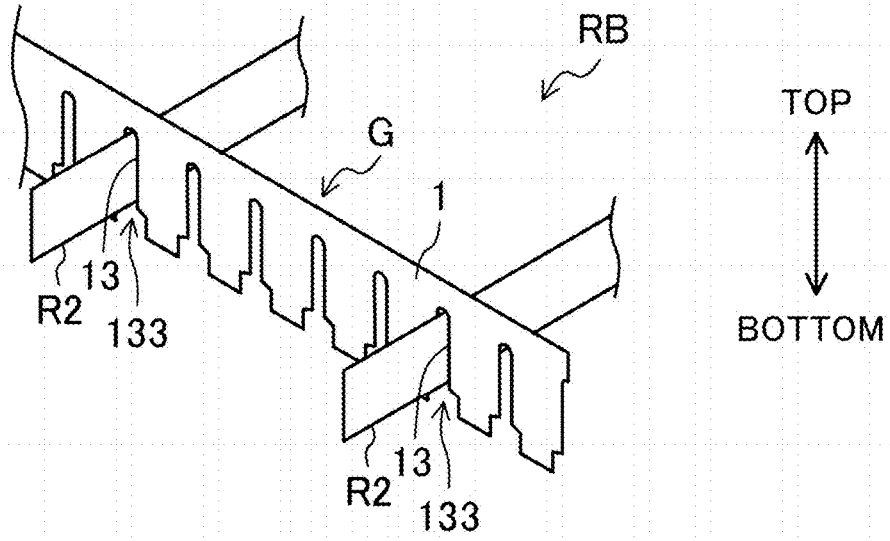
FIG. 4C is a perspective view of a support.
Figure 5B:
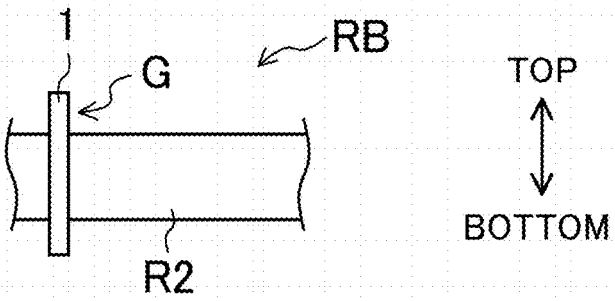
FIG. 5B is a side view of the support.

As illustrated in FIGS. 4C, 5A, and 5B, the fin (1) that has fallen off the third bed (Q24) reaches the stacking spot (RB). At this time, the fin (1) falls in the downward position (G), and the supports (R2) enter the fin slits (13) through the openings (133) and are caught in the fin slits (13).

When the process of changing the position of the fin (1) at the position changing spot (QB) is performed as in the second variation for the multiple fins (1), the fins (1) are horizontally stacked in the downward position (G) at the stacking spot (RB) as in the first stacking example (see FIG. 3).

Third Embodiment

A third embodiment of the method for stacking the fins (1) will be described below.

Configuration of Fin Position Changing Spot

Figure 6:
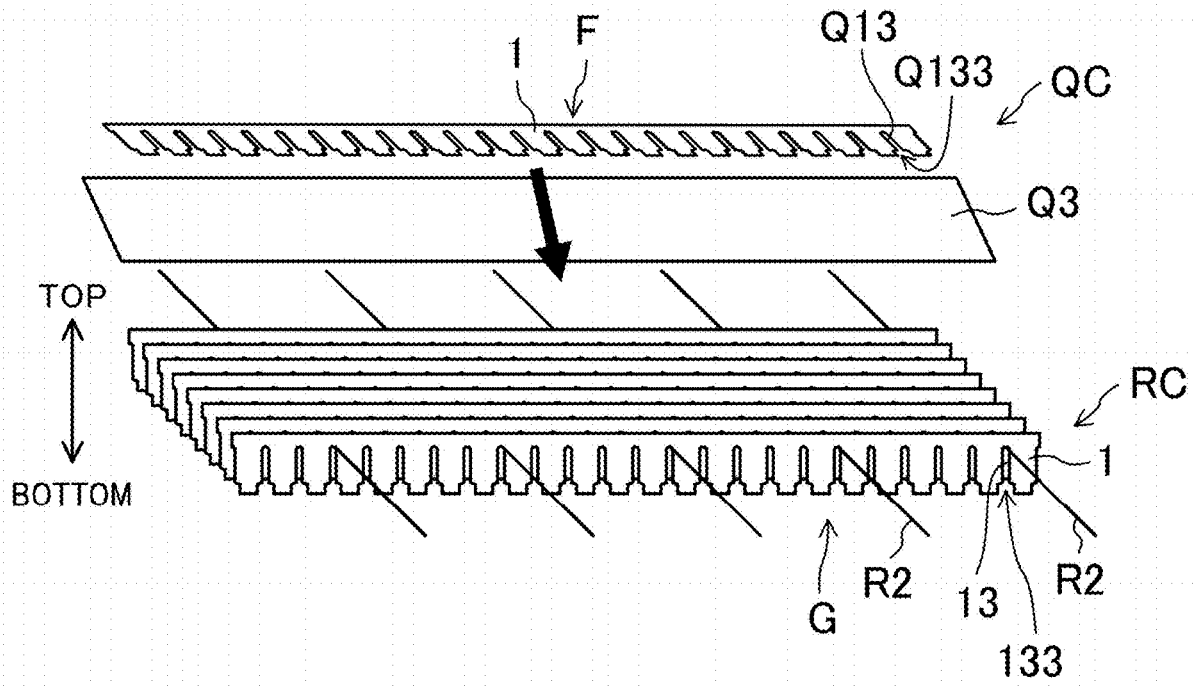
FIG. 6 is a perspective view of a configuration of a position changing spot for the fins and a stacking spot for the fins.

As illustrated in FIG. 6, an inclined surface (Q3) inclined downward with respect to the horizontal direction is provided at a position changing spot (QC) for the fins (1). Multiple supports (R2) are provided at the bottom of the inclined surface (Q3).

Third Variation of Fin Position Change

The fin (1) manufactured at the manufacturing spot (P) (see FIG. 2) is disposed in the horizontal position (F) above the inclined surface (Q3) with the opening (133) of the fin slit (13) facing the inclined surface (Q3). The fin (1) placed above the inclined surface (Q3) slides down the inclined surface (Q3) when pushed toward the inclined surface (Q3) by an arm member (not shown). The fin (1) is inclined along the inclined surface (Q3) when sliding down the inclined surface (Q3), and thus the position of the fin (1) is changed to make the opening (133) of the fin slit (13) face downward. The fin (1) slides down the inclined surface (Q3) with the opening (133) of the fin slit (13) facing downward. The fin (1) that has reached the bottom of the inclined surface (Q3) moves toward the multiple supports (R2) from the opening (133) side. As a result, any of the supports (R2) enters the fin slit (13) through the opening (133) and is caught in the fin slit (13), supporting the fin (1) in the downward position (G).

When the process of changing the position of the fin (1) by dropping the fin (1) using the inclined surface (Q3) at the position changing spot (QC) is performed as in the third variation for the multiple fins (1), the fins (1) are horizontally stacked in the downward position (G) at the stacking spot (RC) as in the first stacking example (see FIG. 3).

Fourth Embodiment

A fourth embodiment of the method for stacking the fins (1) will be described below.

Configuration of Fin Position Changing Spot and Stacking Spot

Figure 7:
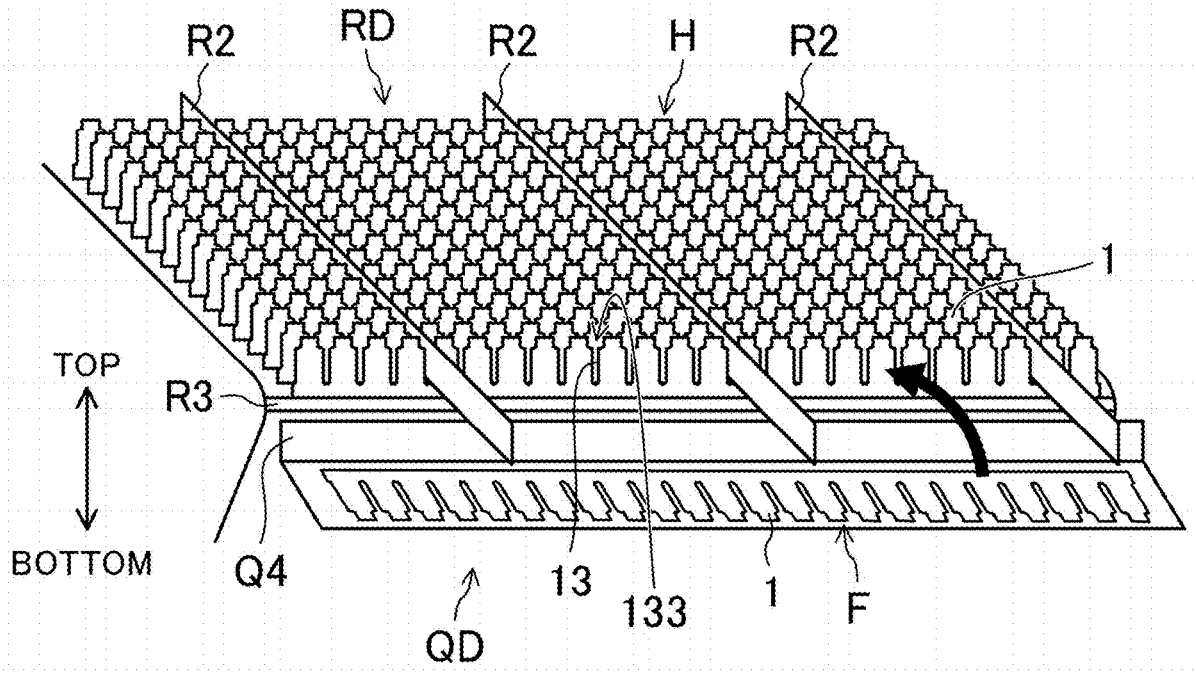
FIG. 7 is a perspective view of a configuration of a position changing spot for the fins and a stacking spot for the fins.

As illustrated in FIG. 7, a rotary platform (Q4) is placed at a position changing spot (QD) for the fins (1). A stacking spot (RD) for the fins (1) is provided with a stacking platform (R3) and a plurality of supports (R2).

The rotary platform (Q4) is rotatably supported with the fin (1) placed thereon. The stacking platform (R3) is a plate-shaped member on which the stacked fins (1) are placed. The rotary platform (Q4) is arranged near the stacking platform (R3). The supports (R2) are disposed above the stacking platform (R3). The supports (R2) are arranged in parallel at intervals.

Fourth Variation of Fin Position Change

The fin (1) manufactured at the manufacturing spot (P) (see FIG. 1) is placed in the horizontal position (F) on the rotary platform (Q4). The rotary platform (Q4) rotates with the fin (1) in the horizontal position (F) placed thereon. The fin (1) rotates together with the rotary platform (Q4). The fin (1) is raised up when the rotary platform (Q4) rotates, and the position of the fin (1) is changed from the horizontal position (F) to an upward position (H).

When the fin (1) is in the upward position (H), the opening (133) of the fin slit (13) faces upward in the vertical direction.

The fin (1) in the upward position (H) is pushed out of the rotary platform (Q4) toward the stacking spot (RD) by an arm member (not shown). As a result, any of the supports (R2) enters the fin slit (13) and is caught in the fin slit (13), and the fin (1) in the upward position (H) is placed on the stacking platform (R3).

Second Example of Stacking Fins

When the process of changing the position of the fin (1) by raising up the fin (1) using the rotary platform (Q4) at the position changing spot (QD) is performed as in the fourth variation for the multiple fins (1), the fins (1) are horizontally stacked in the upward position (H) at the stacking spot (RD).

Advantages

As described above, the fins (1) are arranged at the stacking spot (RA) for the fins (1) with the openings (133) of the fin slits (13) facing upward or downward. Thus, the fins (1) can be horizontally stacked. This allows the multiple fins (1) to be stacked more stably than when the fins (1) are vertically stacked, thereby allowing more fins (1) to be stacked stably. As a result, the conveying process is performed less frequently, thereby allowing stable operation of a manufacturing facility for the fins (1).

While the embodiments and the variations thereof have been described above, it will be understood that various changes in form and details may be made without departing from the spirit and scope of the claims (e.g., (1) below). The embodiments, the variation thereof, and the other embodiments may be combined and replaced with each other without deteriorating intended functions of the present disclosure.

(1) In the first to fourth embodiments, the position changing spot (QA, QB, QC, QD) for the fins (1) may be separated from the manufacturing spot (P) for the fins (1), and the fins (1) manufactured at the manufacturing spot (P) may be conveyed to the position changing spot (QA, QB, QC, QD) by separating the fins (1) from the manufacturing spot (P) using a conveying member such as a conveyor. This can keep the fins (1) from remaining in the manufacturing spot (P) for the fins (1), thereby allowing smooth manufacture of the fins (1).

As can be seen from the foregoing description, the present disclosure is useful for a method for stacking fins.

The invention claimed is:

1. A method for stacking a plurality of fins each having a plurality of fin slits for receiving a flat tube, the method comprising:

arranging each of the plurality of fins at a fin stacking spot with openings of the plurality of fin slits facing downward, the arranging each of the plurality of fins including inserting a moving member into one or more of the plurality of fin slits and moving the plurality of fins to the fin stacking spot together with the moving member while keeping the plurality of fins in a downward orientation in which the openings of the plurality of fin slits face downward, the arranging each of the plurality of fins further including transferring the plurality of fins to a support arranged at the fin stacking spot such that the support is inserted into another one or more of the plurality of fin slits and supports the plurality of fins in the downward orientation, the other one or more of the plurality of fin slits being different from the one or more of the plurality of fin slits into which the moving member was inserted.

2. The method of claim 1, further comprising: lifting up a fin among the plurality of fins.

3. The method of claim 1, further comprising: dropping a fin among the plurality of fins to make the openings face downward.

4. The method of claim 1, further comprising: conveying a fin among the plurality of fins manufactured at a fin manufacturing spot to separate the fin from the fin manufacturing spot.

5. The method of claim 1, wherein the plurality of fins are stacked to be arranged in a direction of extension of the support.

6. The method of claim 1, further comprising: stacking the plurality of fins horizontally.

* * * * *